US005272796A

United States Patent [19]

Nichols

[11] Patent Number: 5,272,796

[45] Date of Patent: Dec. 28, 1993

[54] SLIP RESISTANT SHOE LACE AND METHOD FOR MANUFACTURING SAME

[75] Inventor: Steven B. Nichols, Brentwood, Calif.

[73] Assignee: K-Swiss, Inc., Chatsworth, Calif.

[21] Appl. No.: 884,919

[22] Filed: May 18, 1992

[51] Int. Cl.[5] ..... A43C 9/00

[52] U.S. Cl. ..... 24/712; 24/713; 24/715.4; 87/9

[58] Field of Search ..... 24/712, 712.1, 712.9, 24/713, 714.3, 715.3, 715.4, 715.5, 715.6, 715.7; 87/6, 9

[56] References Cited

U.S. PATENT DOCUMENTS

| | | | |
|---|---|---|---|
| 1,476,348 | 12/1923 | Miller | 24/712 |
| 1,649,027 | 11/1927 | Gunn | 24/715.3 |
| 2,145,476 | 1/1939 | Dennis | 24/715.4 |
| 2,477,151 | 7/1949 | Stapleton | 24/713 |
| 2,940,247 | 6/1960 | Kirschbaum | 87/6 |
| 3,059,518 | 10/1962 | Nelson | 24/715.4 |
| 3,078,755 | 2/1963 | Chace, Jr. | 87/9 |
| 3,130,630 | 4/1964 | Dawes | 87/9 |
| 4,930,196 | 6/1990 | Laurin | 24/715.4 |
| 5,029,372 | 7/1991 | Brinson | 24/715.4 |

FOREIGN PATENT DOCUMENTS

| | | | |
|---|---|---|---|
| 0500077 | 2/1939 | United Kingdom | 87/9 |

*Primary Examiner*—Victor N. Sakran
*Attorney, Agent, or Firm*—Drucker & Sommers

[57] ABSTRACT

A slip resistant shoe lace and a method to make same. A slip resistant shoe lace is provided by weaving strands having a conventional frictional coefficient with at least one strand having a higher frictional coefficiency, where the high-friction strands do not extend beyond the outer perimeter of the lace. The high-friction strands can be made by impregnating conventional strands with friction-enhancing substances such as resin or rubber, by using a unitary strand made of material such as rubber or soft plastic, or by using strands with grooves or serrations formed on its outside surface.

17 Claims, 2 Drawing Sheets

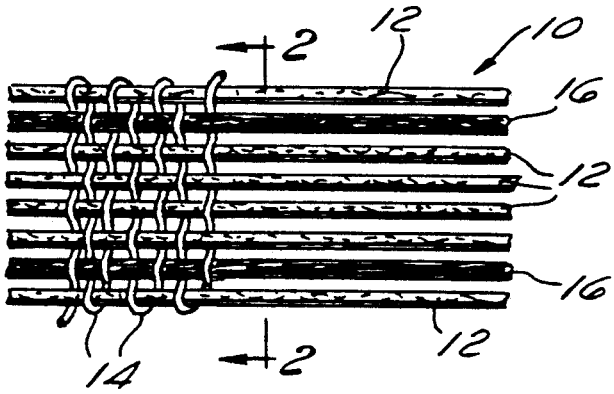
Fig. 1
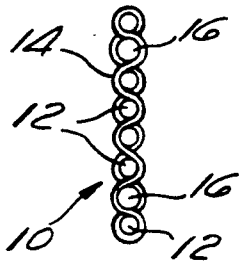
Fig. 2
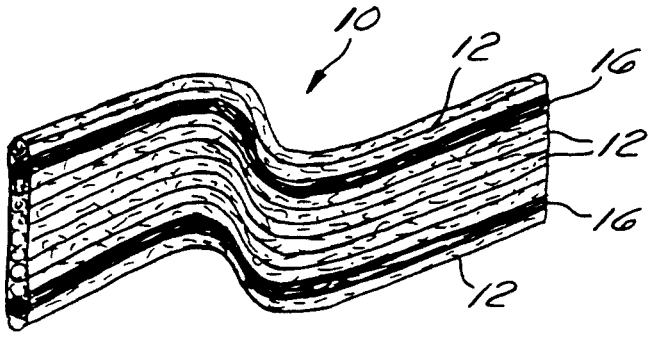
Fig. 3
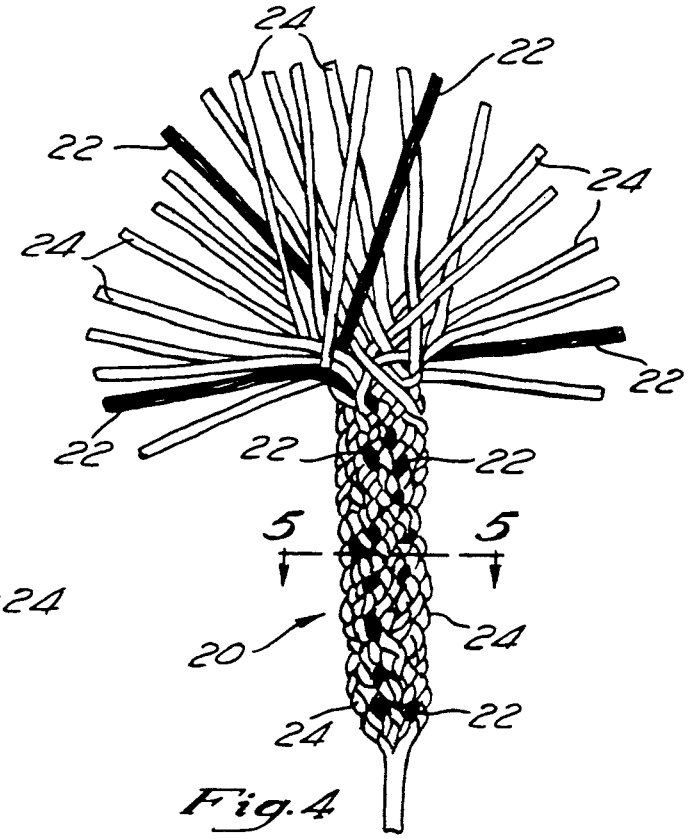
Fig. 4
Fig. 5
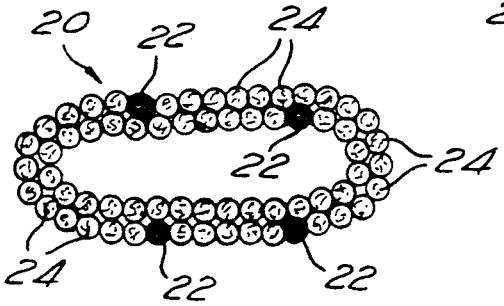

SLIP RESISTANT SHOE LACE AND METHOD FOR MANUFACTURING SAME

BACKGROUND OF THE INVENTION

1. Field of the Invention

The present invention relates to the field of slip resistant shoe laces and a method of manufacturing same.

2. Brief Description of the Prior Art

Before the invention presented herein, others have devised slip resistant shoe laces. U.S. Pat. No. 2,477,151 to Stapleton discloses a shoe lace comprising an elongate and relatively wide and relatively yieldable braided flat lace body member, with a braided and relatively unyieldable strand laced back and forth centrally through the body member, with those portions lying on the faces of the body member providing longitudinally spaced and raised, alternately disposed ribs on the faces of the body member. The braided strand is said to be preferably stiffened and made to have a high frictional characteristic by impregnating it with certain latexes and/or resins. The high-friction strand of the Stapleton lace is looped in and out through the flat body member after the body member is woven. This construction method not only requires an extra step in the manufacturing method, but also results in the production of a finished shoe lace which has a bumpy and irregular appearance.

Also, known in the art is U.S. Pat. No. 4,930,196 to Laurin which discloses a slip resistant shoe lace having a normal lace body, but whose outside surface is sprayed with a line or lines of a colored rubber material in a separate step to enhance its slip resistant quality.

OBJECT OF THE INVENTION

It is an object of the invention to provide a slip resistant shoe lace which is easily manufactured in the conventional manner by braiding, weaving, knitting, or other conventional interlacing methods, but which is durable and has enhanced frictional characteristics to prevent the tied shoe laces from untying at the bow. Another object of the invention is to provide an economical and efficient method to manufacture the slip resistant shoe lace.

SUMMARY OF THE INVENTION

According to one aspect of the present invention herein, a slip resistant shoe lace is provided having a plurality of interwoven strands, and is characterized by:

- a plurality of conventional, i.e. untreated strands of material, such as cotton, polyester, or nylon; and
- at least one high-friction strand having a coefficient of friction higher than that of said plurality of untreated strands, said untreated strands and at least one high-friction strand being interwoven together to result in said slip resistant lace.

A second aspect of the present invention is a method of manufacturing a slip resistant shoe lace comprising the steps of:

- preparing a plurality of conventional, i.e. untreated strands of material;
- preparing at least one strand having a higher frictional coefficient than said conventional strands; and
- interweaving said conventional strands and said at least one high-friction strand together in such a manner that said at least one high-friction strand does not extend beyond an outer perimeter of the slip resistant shoe lace.

BRIEF DESCRIPTION OF THE DRAWINGS

The invention is described below in greater detail with reference to the drawings.

FIG. 1 is a fragmentary top plan view of a first embodiment of the slip resistant shoe lace of the invention;

FIG. 2 is a cross-sectional view of the lace of FIG. 1 through 2—2;

FIG. 3 is a fragmentary perspective view of the shoe lace of FIG. 1.

FIG. 4 is a fragmentary view of a second embodiment of the slip resistant shoe lace of the invention;

FIG. 5 is a cross-sectional view of the lace of FIG. 4 through 5—5;

DETAILED DESCRIPTION OF THE PREFERRED EMBODIMENT

Figure 6:
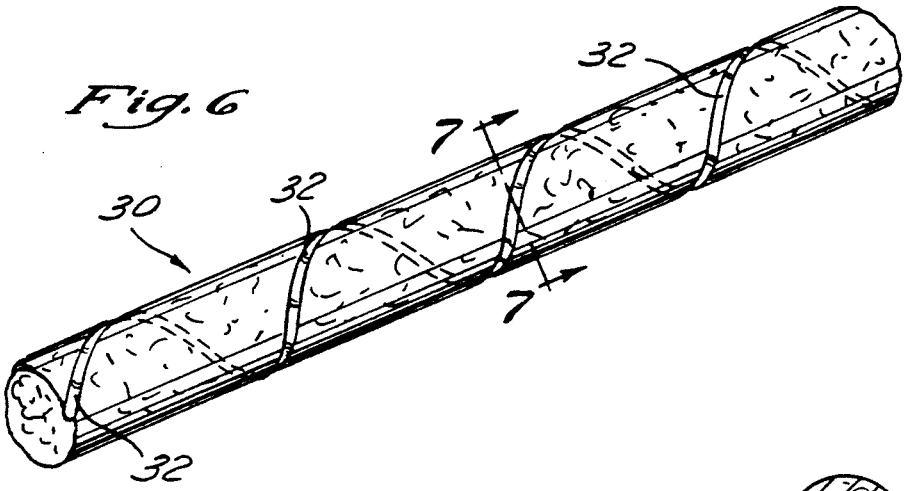
FIG. 6 is a side view of a third embodiment of a strand which can be used to weave into high friction shoe laces.

In FIG. 1, there is depicted a fragmentary top plan view of a first embodiment of the slip resistant shoe lace 10 made by weaving. The shoe lace 10 has a plurality of braided warp strands 12, and a woof strand 14 which holds the warp strands 12 together. One or more high-friction strands 16 are woven directly amongst the warp strands 12 during the weaving process. These high-friction strands 16 have a higher frictional coefficient than the warp strands 12 or woof strand 14. The warp strands 12 and woof strand 14 are preferably made from cotton, nylon, or polyester fibers, but any other conventional natural or synthetic fiber material can be used. Alternately, the woof strand 14 can be a high-friction strand, with or without additional high-friction warp strands 16 woven amongst the conventional warp strands 12.

FIG. 2 is a cross section view showing of the lace of FIG. 1 through view lines 2—2 and FIG. 3 is a perspective view of the lace of FIG. 1.

FIG. 4 depicts a second, braided embodiment of a slip resistant lace 20. High-friction strands 22 are braided amongst conventional strands 24 having a normal frictional coefficient. FIG. 5 is a cross-sectional view of FIG. 4 showing a hollow lace where high-friction strands 22 are braided amongst conventional strands 24. In addition to forming the shoe lace by weaving and braiding, the shoe lace can be formed by the process of knitting, such knitting taking place on conventional shoe lace knitting machines, with the exception that two or more high-friction strands will be substituted for two or more conventional strands. Notwithstanding which strand interlacing method is used to interweave the individual strands together, be it by weaving, braiding, or knitting, the resulting shoe lace will have a greater resistance to inadvertent untying at the bow than do conventional laces.

As with conventional strands 12 or 24, the high-friction strands 16 or 22 can start as strands of cotton, polyester, or nylon fibers. These strands are then coated or impregnated with a soft, high-friction rubber or plastic compound or a waxy substance to impart them with their slip resistant character.

The high-friction strands 16 or 22 can also be made by coating or impregnating untreated strands with resinous material and then curing the resinous material treated strands, if necessary, by conventional methods such as by air drying, heat lamp drying, ultraviolet light exposure and the like (not shown). Thereafter, these cured strands, which have a permanent tacky characteristic, are interlaced with tacky and conventional strands to achieve the desired tacky lace.

Figure 7:
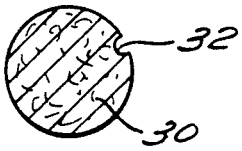
FIG. 7 is a cross-sectional view of the treated lace strand of FIG. 6 through 6—6.

In addition to friction enhancing treatment by coating or impregnating with soft rubber, plastic, or resinous compounds, a strand 30 can be treated by cutting or pressing serrations or grooves 32 on the surface of the individual lace strands, to result in the shoe laces as shown in FIGS. 6 and 7, which will give laces woven therefrom enhanced frictional characteristics, as compared to laces constructed from untreated strands. The treated strands 30 can be prepared, in the case of strands made of synthetic materials such as polyester or nylon, by extrusion methods which will imbue the strands 30 with grooves 32, or by other known methods.

Alternately, the high-friction strands 16 or 22 can be manufactured largely or solely from rubber compounds, plastic compounds, or other materials having a high-friction, tacky, or rubbery, slip resistant texture which resists slipping and untying once the shoe laces 10 or 20 incorporating the high-friction strands 16 or 22 are tied together in a bow, due to the contact of the high-friction strands in the laces with conventional strands, and with other high-friction strands.

Shoe laces 10 or 20 incorporating high-friction strands made by either method have a higher frictional coefficient than conventional shoe laces, thereby minimizing inadvertent untying of the laces at the bow.

A major advantage the resulting laces 10 or 20 have over the prior art laces is that the high-friction strands 16 or 22 are interlaced directly amongst the conventional strands 12 and 24 during the manufacturing process to form a single thickness or layer of material, i.e. a single ply rather than being looped in and out through the body of the lace in several stages as in the lace of U.S. Pat. No. 2,477,151. This is best shown in FIGS. 3 and 4. The lace construction methods of this invention allow the appearance and shape of the lace to remain unaltered, e.g. round, semi-round, or rectangular in cross section, and does not increase the manufacturing cost appreciably.

Figure 8:
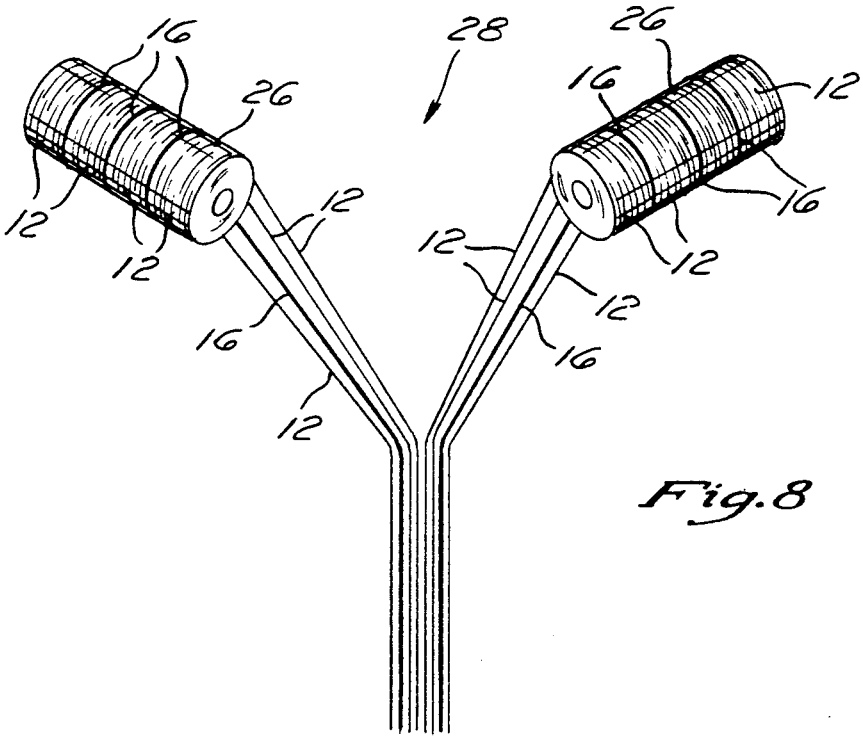
FIG. 8 is a schematic showing of the manufacturing process to manufacture the shoe lace of FIG. 1.

The method by which the lace of FIGS. 1–3 is woven is shown schematically in FIG. 8. During the process of manufacturing the high-friction laces 10, at least one, and preferably two or more high-friction strands 16 are woven directly amongst the warp strands 12 from spools 26 in the same manner that the warp strands 16 are fed from spools 26 on the weaving machine 28. Thus, the process of integrating the high-friction strands 16 does not introduce any additional steps in the weaving process.

The braided lace depicted in FIGS. 4 and 5 can be manufactured with standard shoe lace braiding machines, which are not shown. Knit versions of the slip resistant shoe lace can also be formed on a conventional knitting machine. The treated lace strands of FIGS. 6 and 7 can be interwoven with other treated or untreated strands in the same manner.

The result of any of these approaches will result in a durable shoe lace having enhanced frictional qualities, which will prevent the shoe laces from inadvertently untying, yet having a similar appearance to conventional shoe laces.

It should be borne in mind that the drawings are not rendered in actual scale so that certain features of the invention can be brought out and depicted.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following claims:

I claim:

1. A slip resistant shoe lace having a plurality interwoven strands of material and characterized by:

a plurality of untreated strands of material; and at least one strand treated to have a coefficient of friction higher than that of said untreated strands, said untreated strands and said at least one high-friction treated strand being interwoven resulting in a single ply slip resistant lace.

2. The slip resistant shoe lace of claim 1, wherein said at least one high-friction strand comprises an untreated strand which has been impregnated with a friction enhancing substance.

3. The slip resistant shoe lace of claim 2, wherein said friction enhancing substance is selected from the group consisting of natural latex rubber, synthetic rubber, and plastics.

4. The slip resistant shoe lace of claim 1, wherein said at least one high-friction strand comprises an untreated strand which has been impregnated with a friction enhancing resinous substance.

5. The slip resistant shoe lace of claim 1, wherein said at least one high-friction strand does not extend beyond an outer perimeter of the slip resistant shoe lace.

6. The slip resistant shoe lace of claim 1, wherein said at least one high-friction strand is interweaving together with said untreated strands by weaving, braiding, or knitting.

7. The slip-resistent shoe lace of claim 1, wherein said untreated strands are made of conventional strand materials, such as cotton, nylon, and polyester.

8. The slip-resistent shoe lace of claim 1, having a woof strand and a plurality of warp strands, wherein said warp strands comprise untreated strands and said at least one treated strand.

9. The slip-resistent shoe lace of claim 1, having a woof strand and a plurality of warp strands, wherein said woof strand comprises said at least one treated strand, and said warp strands comprise untreated strands.

10. The slip-resistent shoe lace of claim 9, wherein said woof strand comprises an untreated strand and said warp strands of the shoe lace comprise said at least one treated strands and said untreated strands.

11. The slip-resistent shoe lace of claim 1, having a woof strand and a plurality of warp strands, wherein said wool strand comprises a treated strand and said warp strands comprises treated and untreated strands.

12. The slip-resistent shoe lace of claim 1, wherein said at least one high-friction strand has grooves or serrations formed on its outer surface to give it its enhanced frictional characteristics.

13. The slip resistant shoe lace of claim 12, wherein said grooves or serrations are cut or pressed into the outer surface of the strand.

14. The slip resistant shoe lace of claim 12, wherein said strand material is a synthetic material.

15. A method of manufacturing a slip resistant shoe lace comprising the steps of:

preparing an plurality of untreated strands;

preparing at least one strand having a higher frictional coefficient than said untreated strands; and interweaving said untreated strands and said at least one high-friction strand together in such a manner that said at least one high-friction strand does not extend beyond an outer perimeter of the slip resistant shoe lace.

16. The method of manufacturing a slip resistant shoe lace of claim 15, wherein said step of obtaining at least one high-friction strand comprises the steps of;

obtaining untreated strands; and treating said conventional strands with a friction enhancing substance.

17. The method of manufacturing a slip resistant shoe lace of claim 15, wherein said friction enhancing substances is selected from the group consisting of resinous substances, natural latex rubber, synthetic rubber, and soft plastic.

* * * * *